United States Patent [19]

Mista

[11] Patent Number: 4,911,371

[45] Date of Patent: Mar. 27, 1990

[54] THREAD END SEARCHING ARRANGEMENT

[75] Inventor: Kresimir Mista, Heusenstamm, Fed. Rep. of Germany

[73] Assignee: Karl Mayer Textilmaschinenfabrik GmbH, Fed. Rep. of Germany

[21] Appl. No.: 228,055

[22] Filed: Aug. 4, 1988

[30] Foreign Application Priority Data

Aug. 7, 1987 [DE] Fed. Rep. of Germany ..... 3726337

[51] Int. Cl.[4] ..... B65H 69/04; B65H 63/00

[52] U.S. Cl. ..... 242/35.6 E; 242/36

[58] Field of Search ..... 242/18 AA, 18 EW, 18 R, 242/35.5 A, 35.5 R, 35.6 E, 35.6 R, 36, 37 R

[56] References Cited

U.S. PATENT DOCUMENTS

| | | | |
|---|---|---|---|
| 3,608,843 | 9/1971 | Sledlich | 242/35.6 |
| 4,009,840 | 3/1977 | Müller | 242/35.6 E |
| 4,576,340 | 3/1986 | Aretz et al. | 242/35.5 A |
| 4,619,416 | 10/1986 | Matsui et al. | 242/35.5 R |
| 4,634,065 | 1/1987 | Kupper et al. | 242/18 R |
| 4,735,369 | 4/1988 | Suzuki | 242/18 R |

FOREIGN PATENT DOCUMENTS

| | | | |
|---|---|---|---|
| 2444702 | 8/1975 | Fed. Rep. of Germany | 242/36 |
| 2531044 | 1/1977 | Fed. Rep. of Germany . | |

*Primary Examiner*—Stuart S. Levy
*Assistant Examiner*—Eric P. Dunlap
*Attorney, Agent, or Firm*—Omri M. Behr

[57] ABSTRACT

A thread end seeking arrangement for preparing a predetermined length of thread for insertion into a core of a cop carrying the thread. The arrangement includes a streaming channel located at a seeking/detection point for coupling to the cop and receiving the thread from the circumference of the cop. A thread engager is provided at the streaming channel and is spaced from one end of the streaming channel by a distance corresponding to the predetermined length of the thread to be inserted. The thread engager is operable to engage the thread at the end of the predetermined length of the thread.

15 Claims, 2 Drawing Sheets

S

THREAD END SEARCHING ARRANGEMENT

BACKGROUND OF THE INVENTION

The invention is directed to a thread end seeking arrangement employing a cop holding arrangement which is rotatable about a vertical axis and employing a streaming channel for the reception of the thread end wound circumferentially around the cop.

A thread arrangement of this type is a preparation stage for a spooling machine or the like. This arrangement receives spin cops either directly or indirectly from the spinning machine or alternatively, cops which are returned thereto by reason of their rejection from the spooling machine. The thread end is sought, a predetermined length is pulled off and thereafter attached to the cop in a predetermined manner, either by the formation of a plurality of external circumferential loops or, by insertion into the cop core. The thread end prepared in such a way can be readily grasped in the spooling machine and knotted or spliced with the thread end in the winding spool.

In the known arrangement (DEOS No. 3630836), the cop holding arrangement carrying the cop, is transported to such a seeking station on a predetermined pathway. At this point, the suction slit of a suction pipe is provided proximate to the rotating outer surface of the cop. The thread end is grasped by the suction stream and pulled into the suction pipe. Then the cop holding arrangement is moved onto a cutting position. There is then provided above the cop, a combined thread testing and cutting arrangement. The suction pipe bent over the cutting point longitudinal slit so that the portion of thread taken up in the suction pipe can follow the movement of the cop.

If the testing arrangement determines that no thread end has been taken up, the cop is shifted to a side path and brought back to the seeking point by activation of a touching arrangement on the upper surface of the cop. An improved result is alleged to be obtained by the seeking arrangement.

An object of the invention is to provide a thread seeking arrangement of the foregoing type in which the number of process steps through which the cop has to pass is reduced.

SUMMARY OF THE INVENTION

In accordance with the illustrative embodiments demonstrating features and advantages of the present invention, there is provided a thread end seeking arrangement for preparing a predetermined length of thread for insertion into a core of a cop carrying the thread. The arrangement includes a streaming channel located at a seeking/detection point for coupling to the cop and receiving the thread from the circumference of the cop. A thread engaging means is provided at the streaming channel and is spaced from one end of the streaming channel by a distance corresponding to the predetermined length of the thread to be inserted. The thread engaging means is operable to engage the thread at the end of the predetermined length of the thread.

By employing such apparatus, improved testing and/or cutting arrangements are provided in the streaming channel at a distance from the seeking point corresponding to the desired length of the thread end. In this arrangement, there is no requirement for a remote testing be tested and its separation achieved while the cop is still in the seeking position. This leads to a considerable saving in space.

There is a further advantage because the streaming channel has substantially closed walls. Because of the provision of the testing and/or cutting arrangement in the streaming canal, the latter requires no longitudinal slit for the movement therethrough of the thread ends. Thus, it is possible to drive the suction arrangement connected to the streaming channel with a considerably lower consumption of energy or alternatively, a much higher streaming velocity may be utilized, which in turn increases the success rate of the search step.

In a further embodiment, the streaming channel is connected with a suction arrangement and on one side of the cross-section of the streaming channel, there is provided an air cut-off slider which can be moved across the said cross-section by means of a servo motor. By means of this air cut-off slider, the action of the suction arrangement is terminated and the thread end can be manipulated without the further influence of suction.

DETAILED DESCRIPTION OF THE DRAWINGS

Figures 1, 2:
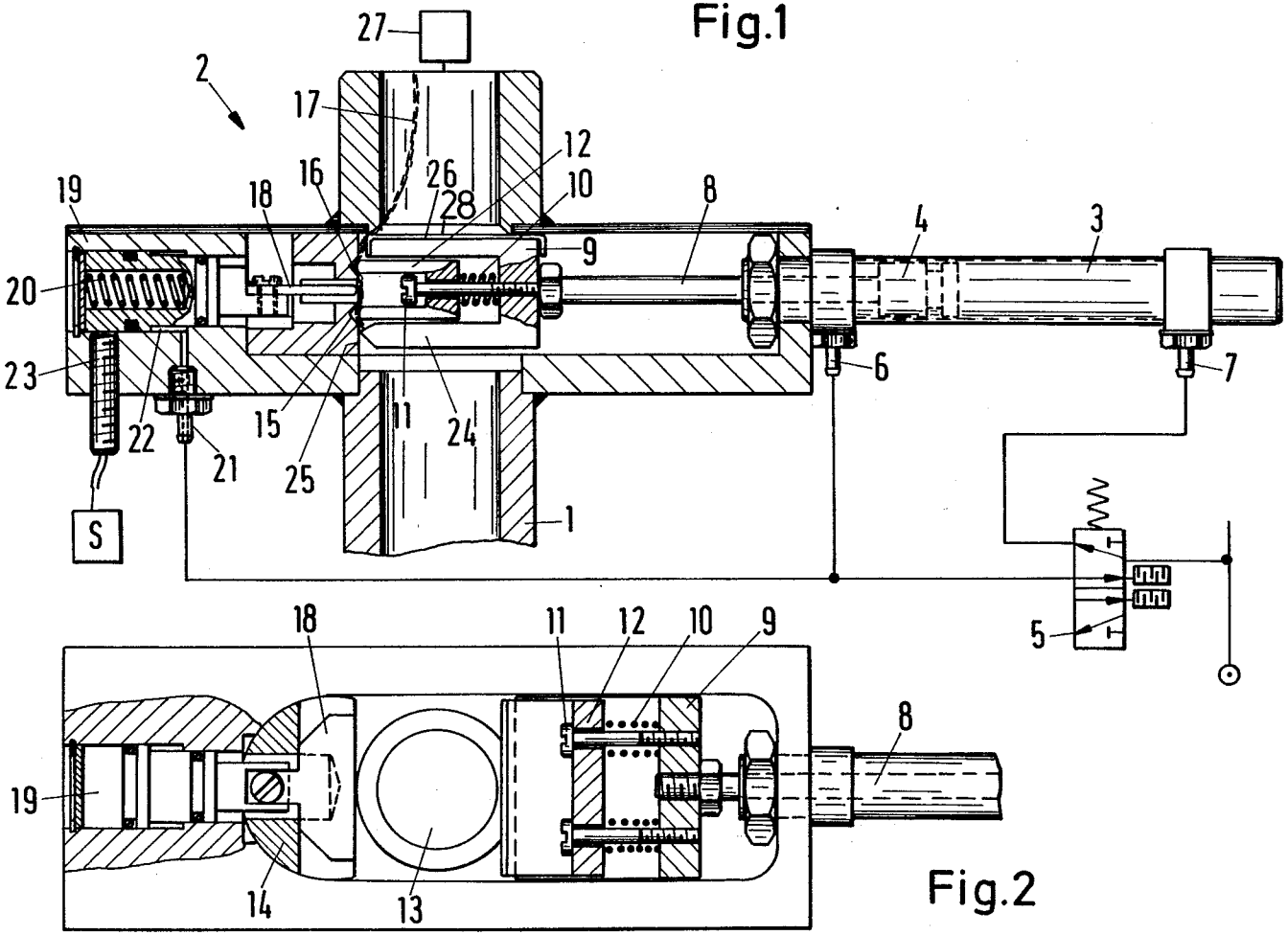
FIG. 1 is an axial cross-sectional view of the testing, cutting and blocking arrangement of the present invention.
FIG. 2 is a transverse cross-sectional view of the arrangement of FIG. 1.

Referring to FIGS. 1 and 2, there is provided into streaming channel 1 which possesses a substantially closed tubular wall, a combined testing, cutting and blocking arrangement 2. This arrangement is activated by an axial servo motor 3 whose pressure volumes on both sides of piston 4 can be supplied with pressurized air via magnetic valve 5, either over connection 6 or connection 7. The appropriate piston rod 8 carries an a U-shaped outer bracket 9 and a U-shaped inner bracket 12 telescopically connected thereto via spring 10 and contact head 11, which may be moved from the position shown in FIG. 1 to the position shown in FIG. 2 and vice versa.

a. Thread Testing Arrangement— on one side of cross-section 13 of streaming channel is provided an inlay 14 having two clamping surfaces 15 and 16. These work together with the arms of bracket 12 in order to hold fast thread segment 17. Between the two clamping surfaces 15 and 16, there is provided a probe 18 which is connected to a piston 19. This piston 19 is biased on one side by spring 20 and, by means of air pressure provided through inlet connection 21 during the backwards movement of piston rod 8 to stepped space 22, to the illustrated end position. The actual position of piston 19 is monitored by sensor 23 to provide a proximity sensor.

Where the probe 18, illustrated in FIG. 1, is held in place by the thread segment, sensor 23 does not communicate. On the other hand, if thread segment 17 fails, the piston 19 moves further to the right so that sensor 23 gives an altered signal. Sensor 23 is connected with a control arrangement S which (by means of signals communicated to conveyor 40 of FIG. 3), ensures that at failure of the thread, the cop remains in the seeking position and a new seeking process is begun.

b. Thread Cutting Arrangement— In a similar manner, it is advantageous to provide a counter surface 25 on one side of the cross-section of the streaming channel 1 and on the other side of said cross-section, to provide a cutting knife 24 which, by means of servo motor 3, is movable across the cross-section, there to work in conjunction with the counter surface 25.

The outer bracket 9 comprises an arm constructed as a cutting knife 24 which works together with countersurface 25 on insert 14 in order to cut thread segment 17 from the desired thread end. The inlay 14 is supported with a cylindrical surface so that the countersurface 25 fits itself to the cutting position of the cutting knife 24. The springs 10 insure that the thread segment 17 is held fast by the inner bracket 12 and only then does the cutting step take place.

It is of course advantageous to provide the bracket 12 and the cutting knife 24 to be operable by the same servo motor 3 and to be coupled to each other over at least one spring. This gives rise to a particularly simple form of construction.

It is also possible to solve this problem of construction by providing cutting knife 24 to form a U-shape similar to a second bracket 12 which overlaps the first bracket.

c. Air Blocking Arrangement— On the upper arm of the outer bracket 9, the air cut-off slider 26 is loosely fixed. It comprises a thin plate having right-angle bends at both ends. Under the influence of the suction provided by suction arrangement 27 in streaming channel 1, the air blocking slider 26 is tightly held against surface 28.

Figure 3:
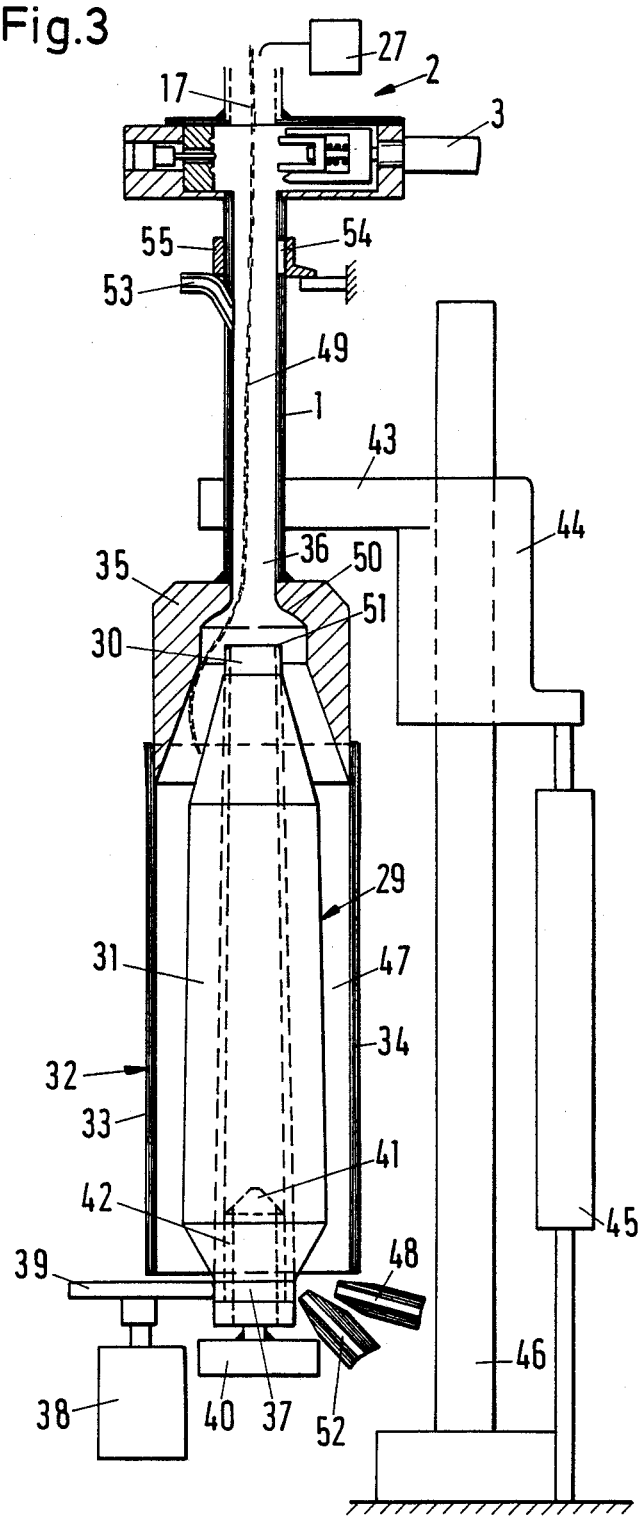
FIG. 3 is an axial cross-sectional view of a searching position for a thread end, employing the apparatus of FIG. 1.

FIG. 3 shows the placement of the combined arrangement 2 in streaming channel 1 of such a seeking position. The individual components of the construction are disclosed in our co-filed application, MAY 3.0-108, Ser. No. 228,056, whose contents are incorporated herein by reference.

A cop 29 comprises a core 30 on which the thread layer 31 is wound. A housing chamber 32 comprising two cylindrical half-shells 33 and 34, as well as the bell-shaped head piece 35 having seeking position end 36 of streaming channel 11, is provided. The core 30 rests on a cop carrying arrangement 37 which can be rotated by means of motor 38 acting over friction disk 39. The cop carrying arrangement 37 is movable on conveyor 40 and carries a peg 41 to take up core 30. The peg 41 comprises a streaming path running into the interior of the core from the underside thereof comprising, for example, a groove or a bore.

The height of the streaming channel 1 may be adjusted by means of headpiece 35. For this purpose, it is connected with arm 43 connected to carrier 44 and may be moved vertically along vertical guide 46 by means of servo motor 45. For the introduction and removal of cops 29, the headpiece 35 is raised by the necessary substantial amount and both half-shells 33 and 34 are correspondingly moved sidewards. Between cop 29 and the housing chamber wall, annular space 47 remains, through which an air stream may pass under influence of suction arrangement 27. This causes the thread end of rotating cop 29 to be loosened and carried into streaming channel 1. In order to amplify this effect, there may be utilized the blasting arrangement 48, which introduces air in annular space 47, having a rotational direction opposite to that of the cop itself.

In the thread seeking step, the cross-section of the streaming channel 1 should be burdened as little as possible by the presence of a test and/or cutting arrangement. It is therefore advantageous to provide, on one side of the cross-section of the streaming channel 1, two clamping surfaces 15 and 16 (FIGS. 1 and 2) and therebetween a thread probe 18 working together with a sensor S, and on the other side of the cross-section, to provide a first bracket 9 which is movable across the cross-section by means of a servo motor 3 and there to operate in conjunction with the clamping surfaces 15, 16. The thread probe 18 responds only to a tightly clamped thread segment. Loose threads, thread conglomerations and the like are not taken into account. This is in contrast, for example, to testing means dependent upon capacitance or optical effects.

After lapse of an appropriate search time, the head piece 35 is moved downwardly by servo motor 45 (Fig. 3) so that the clamping surface 50 surrounding the search setting end 36 lies against the face end 51 of core 30. This in turn clamps thread end 49 and holds it in place. At the same time, the annular space 47 is isolated from streaming channel 1. There thus only remains the streaming through the streaming path 42 via the inside of core 30 and streaming channel 1. This ensures that thread end 49 is held taut. When the servo motor 3 is activated, the testing for the presence of thread segment 17, cutting end of thread end 49 to the desired length and the closing of the upper portion of streaming channel 1 by air cut-off slider 26 takes place. It is advantageous to provide that the air cut-off slider 26 is driven by the same servo motor 3 as the first bracket and/or the cutting knife. This gives rise to a very simple form of construction In particular, it is desirable to form this air cut-off slider 26 by a loose plate which is carried on an arm of the bracket 9 distal from the seeking position end. The plate is thus held closely against its seating 28 by the force of suction.

Between the air cut-off slider 26 and the seeking position end, it is advantageous to provide at least one air inlet opening 54 (FIG. 3) for the provision of an air stream directed towards the seeking position end. By means of a thus generated stream, the thread end 49 may be brought into the inside of the cop core 30. The air inlet opening 54 may, if desired, be combined with an air blast arrangement. It is also possible to provide it as closable air inlet opening which opens into the general atmosphere. This acts as a suction opening when the counter-stream in the streaming channel 1 is provided by suction forces or when the blasting stream pulls in extra air by the injection mechanism.

If no thread is present, the searching step is repeated one or more times. For this reason it is advantageous to provide a control arrangement which, upon indication of failure of presence of the thread in the testing step, permits the cop to remain in the searching position and starts a further search cycle. Since the cop 29 is still in the searching position during the testing for the thread, the possibility exists to immediately recommence a further searching step. This leads to a substantial saving in time, since the cop need not be lead to a slide-path to be recycled to the search position.

The control arrangement can be programmed to operate an additional thread loosening arrangement in the repeated search step. This increases the possibilities of success. Among the possibilities for such a thread loosening arrangement, there may be considered means for mechanical impacting upon the cop and the like. However, since these require the higher consumption of energy or risk damaging the thread, at least one search step should be carried out without these additional measures.

The blasting arrangement 48 can be utilized as an additional thread loosening means in the second search step. A further blasting jet 52 can be put into operation during the third searching step.

Thereafter, air is injected in the contrary direction in streaming channel 1 through air jet arrangement 53. Additionally, by action of the injector mode of the air of the jet stream, air is sucked in through opening 54 which is operated by motion of headpiece 35. During the searching step, opening 54 is closed by ring valve 55, but is opened when this is moved downwardly into the clamping position. By means of this air stream, thread end 49 is driven into the interior of core 30. Thereafter, the housing chamber 32 is opened and cop 29 is moved on.

The above recited embodiments may be varied in several ways without departing from the basic concept. For example, the air stream in channel 1 can be provided solely through use of the blast arrangement 48. Instead of blast arrangement 53, there may be provided a suction arrangement at the lower end of the cop carrying arrangement, which gives rise to this counterstream. Instead of the combined arrangement 2, three individual arrangements may be employed which take over the function of the combined arrangements.

What is claimed is:

1. Thread end seeking arrangement for preparing a predetermined length of thread for insertion into a core of a cop carrying the thread, comprising:

a streaming channel located at a seeking/detection point for coupling to said cop and receiving the thread from the circumference of the cop;

thread clamping means provided at said streaming channel and spaced from the end of said streaming channel proximal to said cop by a distance substantially corresponding to the predetermined length of the thread to be inserted, said thread clamping means being operable to clamp said thread substantially at the end of said predetermined length of the thread;

a detecting arrangement at said streaming channel and spaced from the end of said channel proximal to said cop by a distance corresponding to the predetermined length of the thread to be inserted, for providing an absence signal, adjacent to and co-acting with said thread clamping means for detecting said thread at said seeking/detection point; and a cutting arrangement for said thread, at said streaming channel and spaced from the end of said channel proximal to said cop by a distance corresponding to the predetermined length of the thread to be inserted, located between said thread clamping means and said cop.

2. Thread end seeking arrangement according to claim 1, wherein said streaming channel has substantially closed walls.

3. Thread end seeking arrangement according to claim 1, further comprising:

a control arrangement coupled to said detecting arrangement for initially operating said thread clamping means for each cop and for repeating the operation of said thread clamping means in response to said absence signal.

4. Thread end seeking arrangement according to claim 3 comprising:

thread loosening jet mounted adjacent a location aligned with said streaming channel for loosening the thread on the circumference of the cop upon said cop being placed adjacent to said jet.

5. Thread end seeking arrangement according to claim 4 wherein said detecting arrangement comprises:

an inlay mounted alongside said streaming channel and having a pair of clamping surfaces;

a sensor mounted between said pair of clamping surfaces;

a thread detector mounted on the same side of said streaming channel as said sensor and coupled to said sensor for operating it in response to the presence and absence of the thread;

a bracket mounted on the side of said streaming channel opposite said inlay to reciprocate transversely through said streaming channel and clamp said clamping surfaces; and central motor for reciprocating said bracket.

6. Thread end seeking arrangement according to claim 5 wherein said cutting arrangement comprises:

a cutting knife mounted on the same side of said streaming channel as said bracket to reciprocate through said streaming channel, said inlay having a counter surface facing said cutting knife; and resilient means coupled between said bracket and said knife, said central motor being coupled to said bracket and said knife for reciprocating them and for reciprocating said cutting knife against said counter surface.

7. Thread end seeking arrangement according to claim 6 wherein said knife is shaped and positioned to straddle and guide said bracket.

8. Thread end seeking arrangement according to claim 1 wherein said cutting arrangement comprises:

an inlay having a counter surface on one side of said streaming channel;

a cutting knife mounted on the other side of said streaming channel to reciprocate through it; and a control motor for reciprocating said cutting knife against said counter surface.

9. Thread end seeking arrangement according to claim 8 wherein said knife is positioned along the length of said streaming channel between said cop and said inlay.

10. Thread end seeking arrangement according to claim 1 comprising:

a suction means mounted at said streaming channel to produce an airflow past said seeking/ detection point; an air cutoff slide mounted at said streaming means to reciprocate across and throttle it; and a motor coupled to said slide for reciprocating it.

11. Thread end seeking arrangement according to claim 10 wherein said motor is coupled to said thread engaging means for reciprocating it.

12. Thread end seeking arrangement according to claim 10 wherein said slide comprises:

a plate loosely carried by said thread engaging means on a side of it distal to said cop.

13. Thread end seeking arrangement according to claim 12 wherein said streaming channel has at least one air entry opening for producing an air jet in said channel directed toward said cop.

14. Thread end seeking arrangement according to claim 13 comprising:

an air jet valve coupled to said air entry opening for closing and opening it.

15. Thread end seeking arrangement according to claim 14 wherein said air jet valve is operable to vent said air entry opening to atmosphere

* * * * *